US005632052A

United States Patent [19]

Michel

[11] Patent Number: 5,632,052

[45] Date of Patent: May 27, 1997

[54] PORTABLE POSITIONING AND MOBILITY DEVICE FOR DEVELOPMENTALLY CHALLENGED INDIVIDUALS

[76] Inventor: Jeanine Michel, 82 McNomee St., Oakland, N.J. 07436

[21] Appl. No.: 620,684

[22] Filed: Mar. 19, 1996

[51] Int. Cl.[6] ..... A47D 7/00; A47D 13/08

[52] U.S. Cl. ..... 5/655; 5/93.1; 5/98.1; 5/907; 5/922; 128/870

[58] Field of Search ..... 5/655, 93.1, 94, 5/98.1, 600, 620, 907, 424, 922; 128/869, 870, 876

[56] References Cited

U.S. PATENT DOCUMENTS

| | | | |
|---|---|---|---|
| 2,532,837 | 12/1950 | DePuy | 5/655 |
| 2,611,363 | 9/1952 | Peters | 128/870 |
| 2,836,833 | 6/1958 | Carlson | 5/655 |
| 3,309,719 | 3/1967 | Bader et al. | 5/98.1 |
| 3,522,804 | 8/1970 | Towbin | 128/133 |
| 3,781,931 | 1/1974 | Knickerbocker | 5/655 |
| 3,848,277 | 11/1974 | Regiutti | 5/93.1 |
| 4,287,620 | 9/1981 | Zur | 5/68 |
| 4,607,885 | 8/1986 | del Fierro | 297/397 |
| 4,752,982 | 6/1988 | Jones et al. | 5/433 |
| 4,754,509 | 7/1988 | Pollard | 5/425 |
| 4,788,726 | 12/1988 | Rafalko | 5/93 R |
| 4,800,600 | 1/1989 | Baum | 5/93 R |
| 4,872,228 | 10/1989 | Bishop | 5/425 |
| 4,873,734 | 10/1989 | Pollard | 5/425 |
| 4,999,863 | 3/1991 | Kane | 5/98.1 |
| 5,058,912 | 10/1991 | Harroun | 280/87.021 |
| 5,165,130 | 11/1992 | Wendling | 5/655 |
| 5,189,748 | 3/1993 | Garrison et al. | 5/655 |
| 5,216,772 | 6/1993 | Clute | 5/655 |
| 5,261,133 | 11/1993 | Wilkerson | 5/655 |
| 5,269,323 | 12/1993 | Krouskop | 128/845 |
| 5,272,780 | 12/1993 | Clute | 5/655 |
| 5,310,245 | 5/1994 | Lyszczasz | 297/219.12 |
| 5,347,669 | 9/1994 | Neviaser et al. | 5/655 |
| 5,351,348 | 10/1994 | Beger | 5/420 |
| 5,359,739 | 11/1994 | Rains et al. | 5/81.1 |
| 5,367,730 | 11/1994 | Sher | 5/655 |
| 5,371,909 | 12/1994 | McCarty | 5/655 |
| 5,392,785 | 2/1995 | Donahue | 128/865 |
| 5,406,655 | 4/1995 | Samlin | 5/655 |
| 5,490,292 | 2/1996 | Auburn | 5/655 |
| 5,566,407 | 10/1996 | Lien | 5/655 |

FOREIGN PATENT DOCUMENTS

| | | | |
|---|---|---|---|
| 2211401 | 7/1989 | United Kingdom | 5/93.1 |

OTHER PUBLICATIONS

Tumble Forms® Catalog (1990).

Achievement Products® Catalog 500 (Feb. 1993).

*Primary Examiner*—Alexander Grosz

*Attorney, Agent, or Firm*—Pennie & Edmonds

[57] ABSTRACT

The invention relates to a portable positioning and mobility device for developmentally and/or physically challenged individuals comprising an enclosed treatment compartment adapted to permit a caregiver to provide therapeutic treatment to infants and young children therein without danger of unintended displacement of the patient; frame means surrounding the treatment compartment and supporting same, adapted to optionally provide rolling motion of the device in substantially any direction in a horizontal plane, and a pad covering at least the base of the treatment compartment, the pad having on at least one surface thereof a plurality of highly colorful, high-contrast, infant-stimulating designs.

20 Claims, 4 Drawing Sheets

PORTABLE POSITIONING AND MOBILITY DEVICE FOR DEVELOPMENTALLY CHALLENGED INDIVIDUALS

BACKGROUND OF THE INVENTION

1. Field of the Invention

The invention relates to a portable positioning and mobility device useful in providing physical and/or occupational therapy to developmentally/physically challenged individuals. More particularly, the compact, portable device is designed for use in an early intervention program involving, e.g., pre-term infants or young children with medically and/or physically compromising conditions such as failure to thrive or low birth weight.

2. Description of the Prior Art

Every year, in the United States and worldwide, large numbers of developmentally challenged children are born. Such children may suffer, for example, from conditions such as low birth weight and/or failure to thrive, often resulting in a decreased range of motion and/or in generalized developmental delays. It is desirable, therefor, for such individuals, also generically referred to herein as "children" or "patients", to receive therapeutic treatment for developing or enhancing their positioning, mobility or other motor skills as soon after birth as possible.

In the case of infants and young children, however, such treatments are difficult to carry out because the equipment and associated supplies currently available in the marketplace to facilitate therapy of this type are typically designed and constructed for use in treating older children and young adults. They do not, therefore, take into account the specific needs of those working with infants and children up to about forty pounds in weight and/or two years of age. Equipment manufactured specifically for use by infants and/or small children for therapeutic treatment, such as infant walkers and infant feeder seats placed on dollies to offer additional movement, do not integrate the two concepts of mobility and alternative positioning necessary to achieve important developmental milestones.

This common problem may be exemplified as follows. Optimal positioning of a child's head, neck and trunk are often ignored when a child who is not necessarily developmentally ready is placed in a walker, therefore fostering inappropriate skills or poor quality of higher developmental milestones occurring due to progression at too rapid a rate. Another example involves infant seats, which are designed to place the child in upright position and often are of a size which does not adequately support the smaller infant, nor does it offer positions other than a reclined upright position.

The devices described above only offer one position, e.g., erect standing or reclined sitting. Moreover they also require the infant to be removed in order to modify the position of the child, which risks deviating the child's position. In summary, therefor, the above-described devices do not offer varied degrees of movement nor do they provide movement in a variety of directions. Most devices presently available for such applications thus offer one position, usually utilizing a reclined feeder seat, maintaining the child in a static non-moveable seated position, rather than permitting a variety of varied developmental positions. Another drawback to many of the devices presently available on the market is that they are cumbersome and non mobile, i.e., they are placed on dollies, or are in the form of a kit which is staticly placed on the floor in the form of a mat with a larger bolster. Thus they can not be placed at tabletop level for the convenience of the treating clinician or caregiver.

There has therefore been a long felt need among caregivers in this field for a readily portable compact device adapted for use in providing positioning and mobility therapy to developmentally challenged infants and very young children.

SUMMARY OF THE INVENTION

It is therefore an object of the present invention to provide an improved, compact, portable positioning and mobility device for use with pre-term, low birth weight physically, developmentally or motorically challenged children which provides a safe system for both positioning and mobility therapy with minimal restraints.

Another object of the present invention is to provide an improved positioning and mobility device having an enclosed treatment area for minimizing the chance that a patient may fall, slip or slide out of the device onto the floor, yet which allows for convenient access to the patient by the caregiver.

An additional object of the present invention is to provide an improved positioning and mobility device utilizing a flexible strap and/or harness arrangement that offer little obstruction to the patient's extremities during positioning while affording safety to the patient in supine, prone, side-lying and supported sitting and which further prevents the patient from sliding or slipping during treatment.

Another object of the present invention is to provide an improved positioning and mobility device with interchangeable pads containing illustrations comprising visually stimulating graphic designs.

Still another object of the present invention is to provide an improved positioning and mobility device utilizing wedges and bolsters scaled to address the pre-term infant or physically or motorically challenged child, affording optimal positioning, utilizing varied positions according to the patient's needs.

Still another object of the present invention is to provide an improved positioning and mobility device having a brake system that is easily operated for securing the device against unwanted movement or optionally to permit movement in a variety of directions.

A further object of the present invention is to provide an improved positioning and mobility device that is compact and easy to use, that affords ready mobility when desired, that provides comfortable positioning for the patient and caregiver who provides therapeutic intervention and that affords the patient the opportunity to experience movement. An opportunity is also afforded to the caregiver to optimally utilize body mechanics to free hands to care for the infant's needs as well as address family routines.

The positioning and mobility device of the invention provides a safe supportive system that encourages the pre-term child with conditions such as failure to thrive or low birth weight but whose use is not limited to these specified conditions. The device is provided to offer children with decreased range of motion and who exhibit generalized developmental delays with an environment in which intervention can be offered. Children who are born with or without physical or motoric difficulty will also benefit when treated in the device described herein as it permits them to experience movement while effective positioning is performed. Motion is provided as is tolerated in a gentle safe manner.

The child's position may be modified through wedges and bolsters (appropriately scaled to address the size of the baby)

in order to stimulate developmental milestones, supporting positions such as extension, prone propping and supported sitting. Effective positioning can assist with efficient respiration. The option for movement provided in a gentle safe situation can also enhance vestibular functioning and midline usage of legs and arms for important activities occurring later in life; such as reaching. A variety of stimulating pads with varied, graphic designs can be included to engage the infant to increase proprioceptive function, to develop an awareness and to begin to integrate the world around him/her.

The invention thus comprises, in a preferred embodiment, a portable positioning and mobility device which comprises a compartment means configured and adapted to facilitate therapeutic treatment of a patient located therein. The patient is selected from the group consisting of infants and young children. The compartment means comprises a base portion as well as means for preventing unintended displacement of the patient from the base portion, such as a pair of opposed side walls extending from the base portion around substantially the entire compartment means.

The invention further comprises a frame means at least partially surrounding the compartment around an outer periphery of the compartment. The frame is secured to the compartment by connecting means joining the frame means to the compartment means. The frame means is adapted for supporting the compartment means and for permitting the positioning and mobility device of the invention to be moved in substantially any direction in a horizontal plane. The frame is preferably formed by a plurality of separate elements, interlocked or adhered together.

The frame means further comprises a plurality of roller means, such as casters, at least one of which is preferably provided with a locking mechanism to prevent unintentional motion of the device.

The compartment means is hung within and supported by the frame means with the use of connecting means comprising, e.g., metal or plastic rings or adjustable metal or plastic clamps, hereinafter referred to simply as "connectors" or "connecting means".

A further embodiment of the positioning and mobility device comprises a pad means for cushioning at least a base portion of the compartment means. The pad means has first and second opposed sides and is provided, on at least one side thereof, with a plurality of infant stimulating designs. The pad is preferably made of a soft cloth (e.g., cotton) or a smooth vinyl or plastic material. The pad means may be secured within the compartment means by, e.g., Velcro® strips, snaps, ties, buttons, etc.

If desired, an optional additional foam pad, configured and sized to cover at least a portion of the base portion of the compartment means can be interposed between the pad means and the base to provide additional cushioning for the patient.

BRIEF DESCRIPTION OF THE DRAWINGS

The above and other objects and advantages of the invention will be apparent upon consideration of the following detailed description taken in conjunction with the accompanying drawings in which like characters refer to like parts throughout and in which.

DETAILED DESCRIPTION OF THE PREFERRED EMBODIMENTS

Figure 3A:
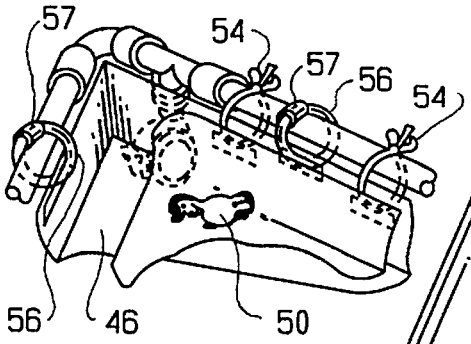
FIG. 3A is a partial perspective view of the pad of FIG. 3 illustrating an alternate method of affixing the pad to the device.
Figure 4:
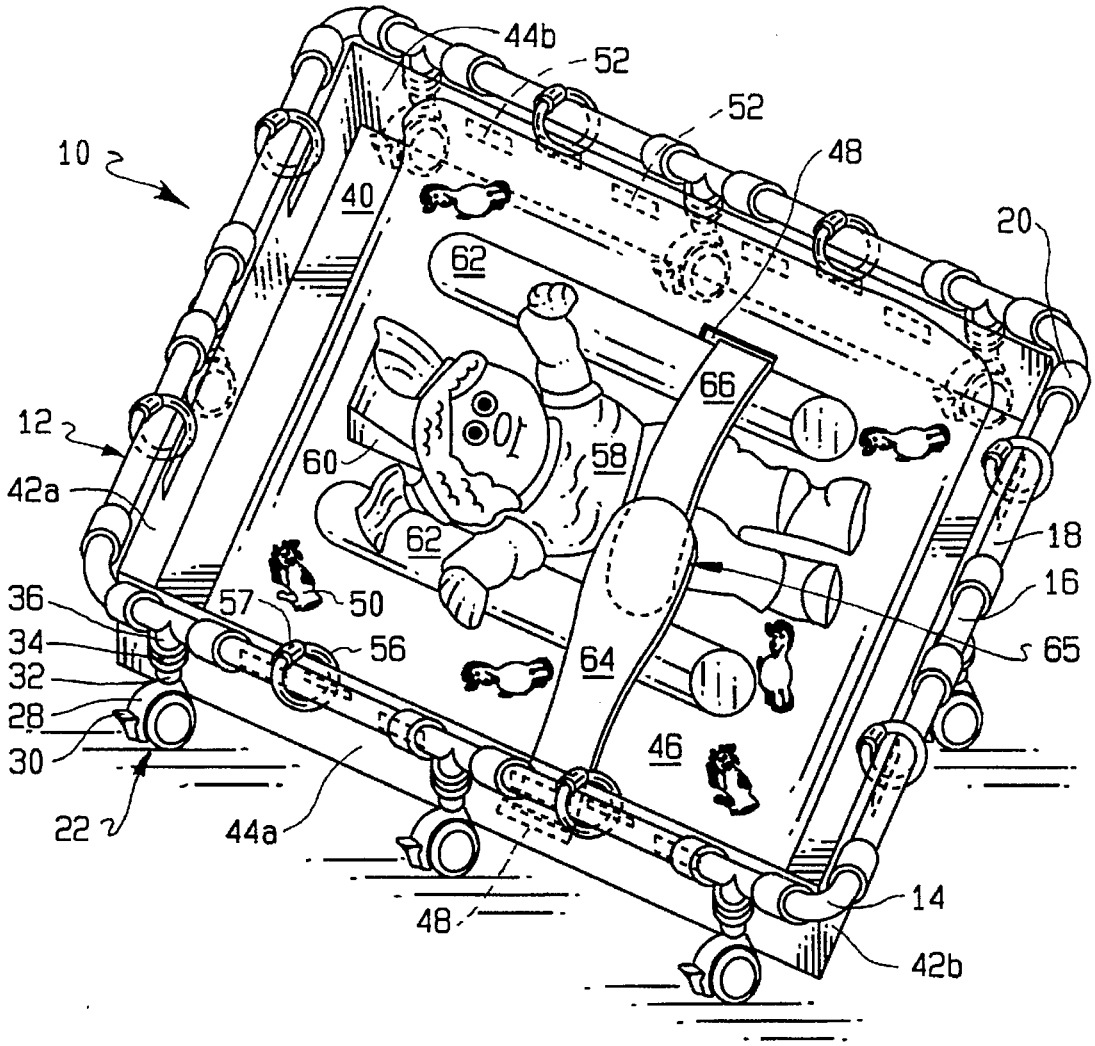
FIG. 4 is a perspective view of one preferred embodiment of the fully assembled positioning and mobility device of the invention.
Figure 5:
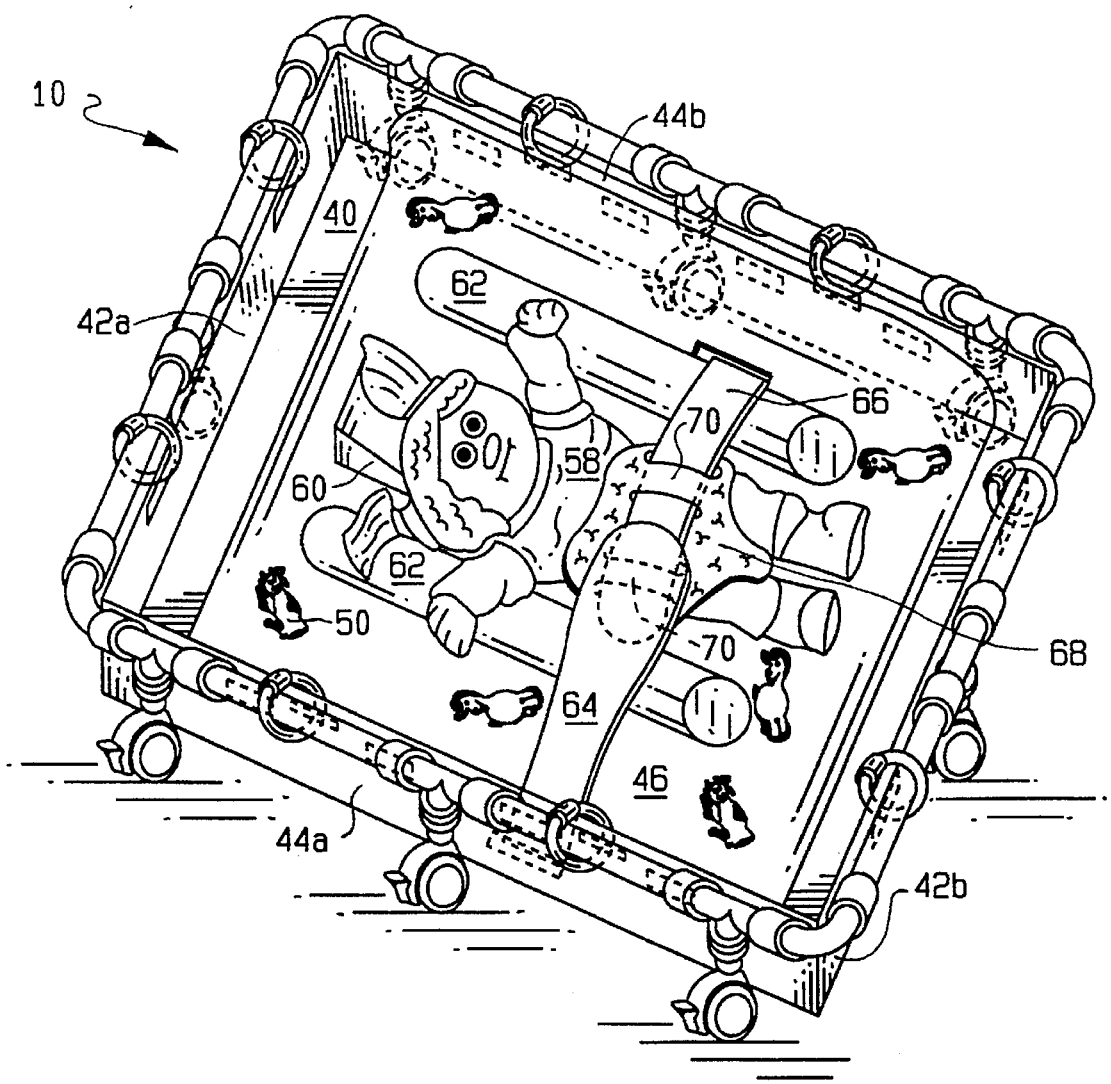
FIG. 5 is a perspective view of an alternate preferred embodiment of the fully assembled positioning and mobility device.

Referring now to the drawings the portable positioning and mobility device 10 of the present invention (referred to generally herein as "device 10"), is comprised of several integrated components. These components are separately illustrated and described with regard to FIGS. 1–3A, while various embodiments of the completely assembled device are shown in FIGS. 4 and 5.

Figure 1:
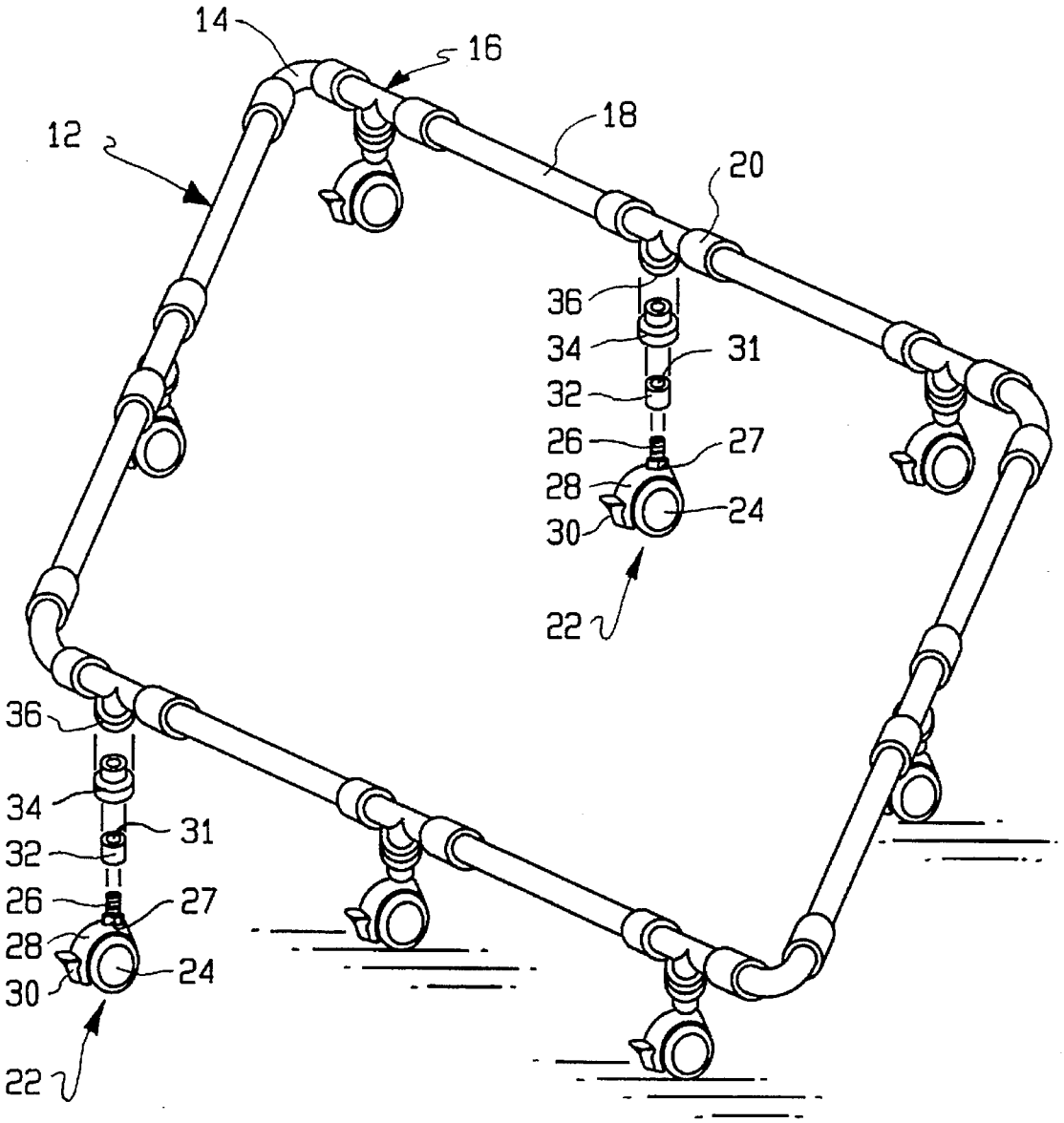
FIG. 1 is a perspective view of a frame portion of the invention adapted for use in supporting and providing mobility to the positioning and mobility device.

Turning initially to FIG. 1 there is shown frame 12 for device 10. In a preferred embodiment frame 12 is comprised of a plurality of separate elements which, upon being assembled as described below, form frame means adapted for providing support and movement to device 10. The benefit of forming frame 12 from a plurality of separate, interconnected elements is that the dimensions of frame 12 may thereby be varied as necessary by adding or subtracting elements from the frame. In an alternate embodiment, however, it is further contemplated that frame 12 may be formed, e.g., molded, as a unitary construct containing only a single, or a limited number of structured elements.

In the preferred embodiment, the frame elements may be formed from, for example, polyvinyl chloride ("PVC") fittings of the type commonly used for plumbing fixtures. Such fittings typically are produced in various diameters and strengths. Frame 12 may be preferably formed from PVC fittings measuring from about ½ to about 4 inches in diameter, with a one inch diameter being preferred although the invention is not limited to the use of fittings having these diameters. As to the strength of the fittings, it is preferred to use 40 weight PVC elements in forming the frame, but weights from 20 to 80 may be used, depending upon the strength needed for the frame which, in turn, depends upon the weight and/or the size of the patient. Alternate materials, i.e., other than PVC, including plastics, various glasses (e.g., fiberglass), metals and even wood, may be substituted for the PVC as long as such materials are capable of supporting the combined weight of the device 10 and the patient.

Frame 12 may be constructed from elements having various "configurations" depending upon the purpose served by each particular element. In the above described embodiment these elements may include "elbows" 14, "tees" 16 and "pipes" 18, the shapes of which are well known to one of ordinary skill in the art. One possible configuration of these elements is shown in FIG. 1 but it should be well understood that a variety of alternate configurations are also possible within the broad scope of the invention. As shown in FIG. 1 the various elements used in forming frame 10 may be interconnected with the use of coupling means such as, but not limited to, coupling rings 20. Coupling rings 20 are typically hollow PVC rings which are smooth bored or threaded upon their interior surfaces to mate with corresponding threads located upon the ends of elements 14, 16, 18. Alternately however, in place of coupling rings 20 a variety of other methods well known in the art may be utilized to link the frame elements together. These linking means may include, for example, the use of adhesives such as epoxies or other glues, welding (e.g., ultrasonic welding) and/or a friction, i.e. snap-together, fit.

The dimensions of frame 12 are not critical. They may be adjusted as necessary by adding or subtracting elements to permit device 10 to accept larger or smaller enclosed therapy compartments as the case may be, for therapeutic treatment of infants or children up to about two years of age and about 30–45 pounds in weight. In a preferred embodiment, however, frame 12 is configured as a rectangle about 24 inches wide and about 36 inches long, a size which permits device 10 to be used for treating most infants and young children up to about two years of age.

As can also be seen from FIG. 1, frame 12 rests on caster assemblies 22 which are capable of rolling and swiveling from side to side to permit movement of device 10 in substantially any direction in a horizontal plane. Device 10 is shown for purposes of illustration with eight casters, but this number is not significant. All that is required is that there be a sufficient number of such casters to provide balance (i.e., to prevent device 10 from tipping) and to permit forward and back and/or side to side movement of device 10 upon a substrate such as a floor, bed or table top.

Casters such as those proposed for use in the invention are relatively well known in the art. In a preferred embodiment each caster assembly 22 comprises a split wheel 24 having an integral stud 26 projecting relatively perpendicularly from between the two rollable portions of the wheel. Fender 28 is mounted over and secured to stud 26 by a friction fit, threads or by an optional fastener, such as a nut 27. Fender 28 comprises locking means 30 adapted to prevent movement of device 10 during therapeutic treatment by preventing wheel 24 from rotating or swiveling once locking means 30 is engaged. Locking means 30 may there be released to permit movement of device 10 during or upon completion of the treatment. A preferred caster is sold under the name Sternco 75 Profil Lock and Swivel Caster by, e.g., Jilson Casters of Lodi, N.J. The invention is not intended to be limited to use with the above-described caster, however as any other roller means, wheel or caster meeting the requirements outlined above would also be acceptable.

Stud 26 of caster assembly 22 is inserted into and through collar member 32 which serves as a spacer between wheel 24 and adapter 34 described below. Collar 32 in the preferred embodiment comprises a tubular element having a hollow inner bore 31 configured and adapted to permit passage of stud 26 at least partially therethrough. Bore 31 may be formed with threads (not shown) corresponding to matching threads on the outer surface of stud 26 for recurring collar member 32 to stud 26. Alternately collar member 32 may be secured to stud 26 in some other fashion, e.g., by a snap fit or with the use of an adhesive. In a further alternate embodiment the function of collar 31 and fastener 27 may be combined in a single element.

In the embodiment described above, collar member 32 is, e.g., friction fitted into the inner circumference of adapter 34 which is, in turn, inserted into the open end 36 a corresponding tees 16 and secured therein by means such as a friction fit or an adhesive.

Figure 2:
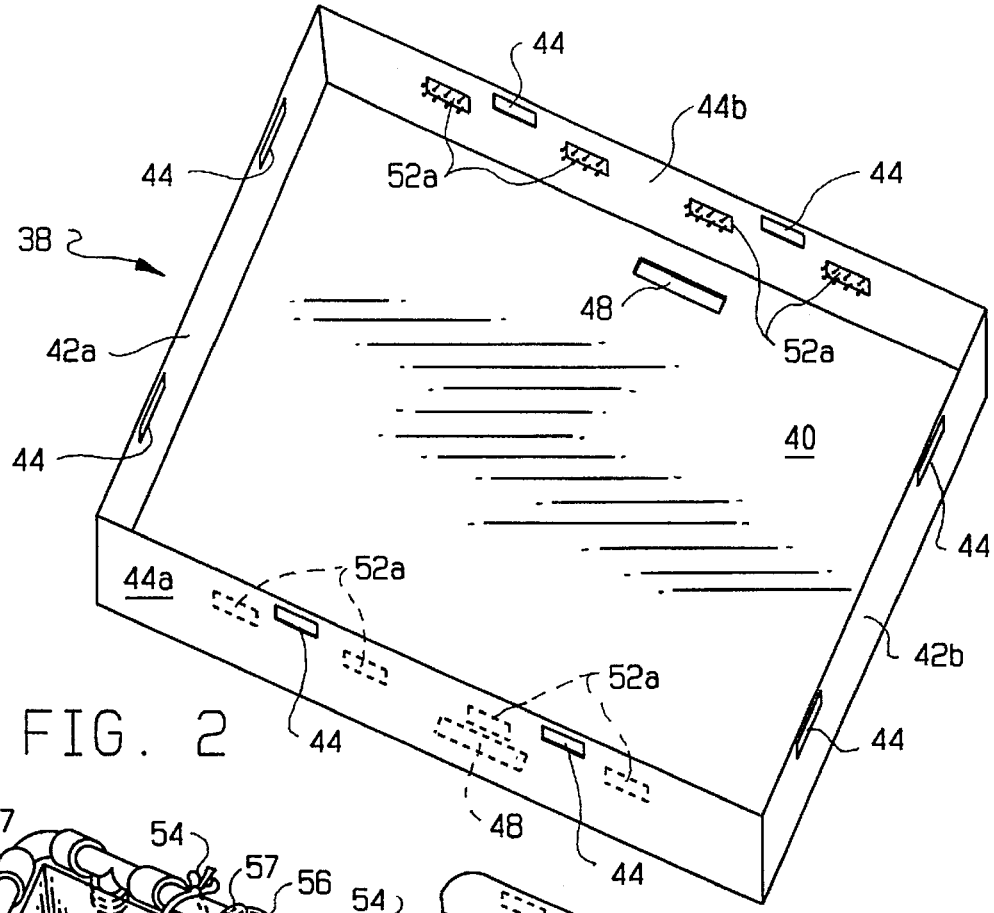
FIG. 2 is a perspective view of an enclosed treatment compartment forming a part of the present invention which is supported by the frame, within which an infant or young child may be placed and optionally secured for therapeutic treatment.

FIG. 2 illustrates another component of device 10, comprising an enclosed treatment compartment 38 configured in the shape of a box having a relatively flat base 40 adapted for supporting the patient and two pairs 42*a, b* and 44*a, b* of opposed side walls adapted to prevent the patient from rolling or otherwise falling out of the compartment. Compartment 38 is illustrated in FIG. 2 with a rectangular shape configured and adapted to fit within frame 12 of FIG. 1. As with frame 12, however, compartment 38 may alternately be produced in a shape other than that shown as long as: (1) there is sufficient space for the patient and, (2) its shape corresponds to that of frame 12 such that compartment 38 can fit within and be supported by frame 12 upon connection thereto. Treatment compartment 38 is also preferably formed of PVC plastic but one of ordinary skill in the art would recognize that PVC could be readily replaced by a variety of alternate materials, e.g., wood, metal, plastic, etc. Compartment 38 is preferably secured within frame 12 by connecting means described below. It is preferred that enclosed treatment compartment 38 hang suspended, i.e., without dragging on the underlying substrate (e.g., table, bed or floor) to permit device 10 to be easily moved on caster assemblies 22.

Figure 3:
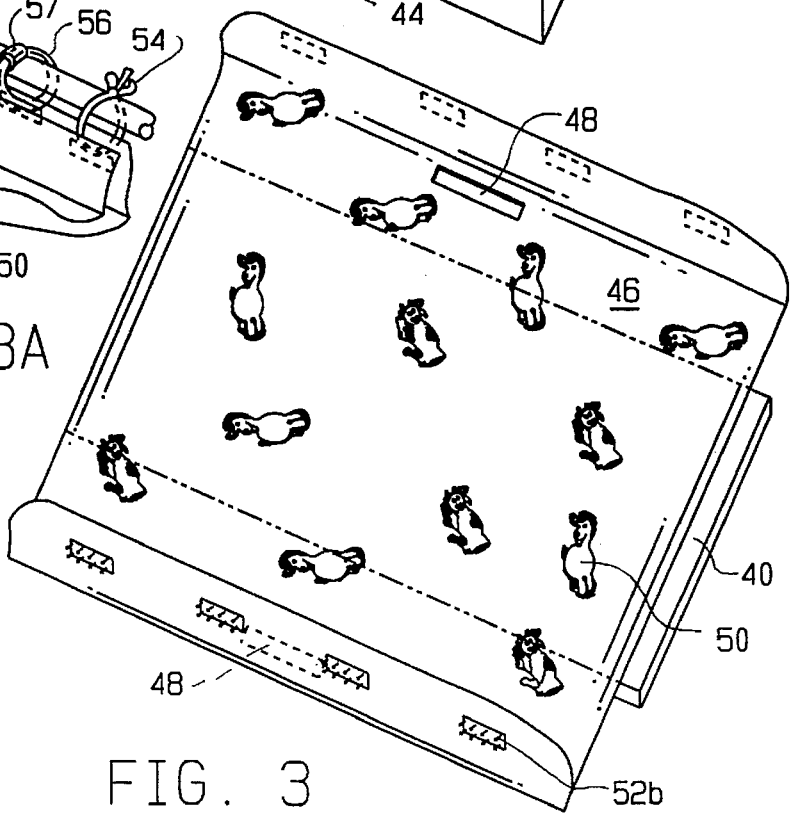
FIG. 3 is an perspective view of a removable pad containing varied graphic designs which cushions the base and sides of the enclosed treatment compartment.

Base portion 40 and optionally side walls 44*a, b* of compartment 38 are covered with a pad 46 as illustrated in FIG. 3. Pad 46, is removable for cleaning and is preferably formed of a cloth such as cotton, or of vinyl or some other plastic material. Corresponding elongated slots are formed in both base 40 and pad 46, which slots are sized and configured to permit passage therethrough of belt means for securing the patient within treatment compartment 38 as discussed below with regard to FIGS. 4 and 5.

Pad 46 is preferably provided on at least one side with a variety of highly colorful, high-contrast infant-stimulating designs 50 for attracting and occupying the attention of younger patients. The designs shown in FIG. 3 are for purposes of illustration only and pad 46 may thus contain any desired pictures or designs. If desired, moreover, the caregiver may maintain a variety of different pads for different patients, each with a different design or illustration. For older patients, the care-giver may utilize a plain pad with no pictures or designs, or alternately, a pad with designs or only one side which can be flipped to one surface or the other depending upon the requirements of use with a particular patient.

Pad 46 may be retained in position within treatment compartment 38 by a variety of means. One such means, shown in FIGS. 2–3, is a plurality of strips of a hook and loop fastener material such as that commonly sold under the trade name Velcro®. As illustrated, a number of hooked (i.e., or looped) strips 52*b* are positioned along at least one edge surface of pad 46 by sewing, gluing, etc. and a corresponding series of hooked or looped strips 52*a* are emplaced on the inner aspect of side walls 42*a,b* and/or 44*a, b* of compartment 38 and even optionally on base portion 40. In an alternate embodiment (not shown) pad 46 may be placed upon base 40 and folded over the top of walls 42*a, b* and 42*a, b* where it may be secured as by the Velcro® strips (in the manner described above) to the outer surface of the walls. In further alternate embodiments of the invention Velcro® strips 52*a, b* may be replaced by adhesive strips or snaps instead of hook and loop fasteners. The number of strips 52*a, b* used is not critical as long as pad 46 is retained in place within compartment 38.

A further alternate method for securing pad 46 as shown in FIG. 3A is the use of cloth ties 54 which extend from pad 46 and are tied around the members comprising frame 12. FIG. 3A also illustrates a preferred connecting means for securing compartment 38 to frame 12. The connecting means comprises clamps 56 closed with, e.g., spring loaded or snap-lock closures 57. Clamps 56 may be formed from plastic, metal or any other suitable material. A ring portion of clamp 56 is passed through each slot 44 in the opposed side walls of compartment 38 and is thereafter clamped around the most proximate member of frame 12 to suspend therapy area 38 within frame 12, after which the ring is shut by closure 57.

A preferred embodiment of the completely assembled device 10 is illustrated in FIG. 4. As shown, device 10 includes frame 12 comprising, e.g., PVC tees 16, elbows 14 and pipes 18 interlocked by the use of coupling rings 20. Hung within frame 12 from clamps 56 is enclosed treatment compartment 38 comprising a box-shaped structure having a base 40 and two pairs of opposed side walls 42*a, b* and 44*a, b*. Clamps 56 are closed by closures 57. Covering at least portions of the bottom and sides of compartment 38 is pad 46. Pad 46 is preferably made of cotton cloth and is preferably provided on at least one side with drawings and/or other types of pictures or illustrations designed to attract and stimulate younger patients. Pad 46 is maintained in position in the subject embodiment with the use of Velcro® strips 52.

As shown in FIG. 4 the patient environment is raised off of the floor and provides the opportunity to retain the patient 58 in a static position or to rotate him or her by rotating device 10 on casters 24. This enables the clinician or trained caregiver the ability to provide a range of movement to the patient in any desired direction.

The patient 58 may be maintained in a predetermined position for useful therapeutic treatment of his or her motor disorder by the use of support means such as one or more wedges 60 and/or bolsters 62 typically formed of a soft cloth or a rubber backing surrounded by a cloth cover. Support means 60, 62 for use with the invention are configured and sized for use with relatively small infants and young children and their use allows the patient to be placed in a variety of developmental positions which foster acquisition of appropriate developmental milestones.

A further means for maintaining patient 58 in position within device 10 is belt 65. Belt 65 comprises elongated strap means with first and second ends 64, 66 extending through slots 48 in base 40 of support 38 and pad 46 and overlapping over patient 58. Alternately two separate belt members may be sewn or otherwise secured to the underside of enclosed treatment compartment 38 and extended through corresponding slots 48 in therapy area 38 and pad 46. In either case belt ends 64, 66 overlap across patient 58 at approximately the midsection of the patient (depending upon the patient's relative size) and are secured one to the other, e.g., with the use of a hook and loop fastener such as Velcro®. Alternate means for securing the belt over the patient may include for example a tongue and buckle arrangement, snaps, clips, etc.

FIG. 5 illustrates an alternate preferred embodiment slightly modified from that depicted in FIG. 4. The embodiment of FIG. 5 differs from that shown in FIG. 4 in that patient 58 may be further immobilized and therefore more fully secured in an appropriate position with the use of a diaper-shaped harness 68 formed of a soft cloth material such as cotton which reduces sliding and/or kicking motions by patient 58. In use, patient 58 is wrapped in harness 68 which is closed around the patient, e.g., by Velcro® tabs, or alternately with the use of other fasteners such as snaps or buttons. Patient 58 is placed in enclosed treatment compartment 38 and further supported, as in the embodiment depicted in FIG. 4, one or more wedges 60 and/or bolsters 62. Belt ends 64, 66 are passed through slots 70 (similar in appearance to belt loops) sewn into harness 68 after which the two belt ends are secured together to at approximately the midsection of patient 58.

The primary emphasis and purpose of device 10 is to provide a relatively simple piece of equipment adapted for use with infants and young children whose particular needs have heretofore remained unmet, for use, as a therapeutic aid to facilitate effective early intervention. In particular, the compact size and ready portability of device 10 facilitates use of the device in the patient's own home at varied levels such as table top or floor level, thus significantly simplifying a majority of patient treatment regimens.

Proper positioning enhances the child's senses, encourages vestibular development through movement & increases the child's awareness of its body parts in space. Proper positioning also aids the child in attainment of developmental milestones, i.e., providing opportunity for optimal positioning and or exploration while gentle graded movement is offered. Proper developmental positioning enhances midline activity, visual regard of environment and self, and prepares the infant for higher developmental milestones. Skills such as head righting, an early developmental milestone, can be stimulated when the infant is properly positioned. Visual, auditory and tactile stimulation can be easily administered while the infant is positioned and supported appropriately.

One skilled in the art will appreciate that the present invention can be practiced by other than the described embodiments, which are presented for the purpose of illustration only and not of limitation. The present invention is therefore only limited by the following appended claims.

I claim:

1. A portable positioning and mobility device for providing physical and/or occupational therapy to developmentally or physically challenged individuals, said device comprising:

compartment means configured and adapted for facilitating therapeutic treatment of a patient located therein, said patient selected from the group consisting of infants and young children, said compartment means comprising a base portion and two pairs of oppositely disposed wall means extending upwardly from said base portion, said wall means substantially surrounding the base portion along an outer peripheral portion thereof;

frame means for supporting said compartment means, said frame means comprised of at least two separate elements which, when connected together, form a shape corresponding to that of the exterior of said compartment means, in surrounding relation to said compartment means and secured thereto by connecting means for joining said frame means and said compartment means, said frame means further comprising a plurality of caster means adapted to permit said device to be rolled in substantially any direction in a horizontal plane; and means attached to said compartment means and securable over or around said patient for substantially preventing said patient from slipping or sliding within said compartment means during treatment.

2. The device of claim 1 which further comprises pad means for cushioning at least the base portion of said compartment means, said pad means having first and second opposed sides.

3. The device of claim 2 wherein said pad means has, on at least one side thereof, a plurality of infant-stimulating designs.

4. The device of claim 2 wherein at least one of said wall means is provided upon a lateral surface thereof with means adapted for securing said pad means.

5. The device of claim 4 wherein said securing means comprises at least one strip of a hook and loop fastener material which, upon contact with a corresponding strip of said material upon said pad means, secures said pad means in place within said compartment means.

6. The device of claim 2 wherein said pad means further comprises a plurality of cloth ties extending from a peripheral portion of the pad means, said ties adapted for securing said pad means within said compartment means by being tied around an adjacent member of said frame means.

7. The device of claim 1 wherein at least two oppositely disposed wall means each define at least one aperture adapted to permit the passage of said connecting means therethrough for securing said compartment means to said frame means.

8. The device of claim 7 wherein said connecting means is a plurality of ring members, each said ring member adapted to fit through one of said apertures and to pass around an adjacent portion of said frame means.

9. The device of claim 7 wherein said connecting means is a plurality of an adjustable clamps, each said clamp adapted to fit through said aperture and to pass around an adjacent portion of said frame means.

10. The device of claim 1 wherein the elements forming said frame means are a plurality of polyvinyl chloride fittings, said fittings having a shape selected from the group consisting of elbows, tees and pipes.

11. The device of claim 10 wherein said polyvinyl chloride elements are connected together by coupling means comprising a ring member having a hollow inner bore portion, said inner bore portion provided with means for securing at least two of said elements therein.

12. The device of claim 10 wherein said polyvinyl chloride elements are connected together by means selected from the group consisting of adhesives, welding and a snap-lock engagement.

13. The device of claim 1 wherein at least one of said caster means further comprises locking means for preventing, when engaged, the caster means from rolling or swiveling.

14. A portable positioning and mobility device for providing physical and/or occupational therapy to developmentally or physically challenged individuals, said device comprising:

compartment means configured and adapted for facilitating therapeutic treatment of a patient located therein, said patient selected from the group consisting of infants and young children, said compartment means comprising a base portion and two pairs of oppositely disposed wall means extending upwardly from said base portion, said wall means substantially surrounding the base portion along an outer peripheral portion thereof;

frame means for supporting said compartment means, said frame means comprised of at least two separate elements which, when connected together, form a shape corresponding to that of the exterior to Said compartment means and secured thereto by connecting means for joining said frame means and said compartment means, said frame means further comprising a plurality of caster means adapted to permit said device to be rolled in substantially any direction in a horizontal plane;

pad means for cushioning at least the base portion of said compartment means, said pad means having first and second opposed sides and, on at least one side thereof, a plurality of infant-stimulating designs; and means attached to said compartment means and securable over or around said patient for substantially preventing said patient from slipping or sliding within said compartment means during treatment.

15. The device of claim 14 wherein said slipping and sliding prevention means comprises belt means adapted for securing said patient in a desired position within said compartment, said belt means extending through apertures defined by the base portion of said compartment means and through corresponding apertures in said pad means.

16. The device of claim 15 wherein said belt means comprises first and second ends, which ends are secured one to another over said patient.

17. The device of claim 16 wherein the first and second ends of said belt means are secured with the use of a hook and loop fastener attached thereto.

18. The device of claim 15 wherein said slipping and sliding prevention means further comprises harness means adapted for use in conjunction with said belt means to retain said patient in a desired position within said compartment.

19. The device of claim 18 wherein said harness means is formed of a soft cloth material and wherein said harness means is fitted around said patient and retained in position thereon by the use of at least one fastener.

20. The device of claim 19 wherein said harness means further comprises two or more loops configured and adapted to permit passage of the first and second ends of said belt means.

* * * * *